US009877533B2

(12) United States Patent
Arnott

(10) Patent No.: US 9,877,533 B2
(45) Date of Patent: Jan. 30, 2018

(54) HEADWEAR ITEM COMPRISING HAIR LOCATING SECTIONS FOR LOCATING A BUNDLE OF HAIR AT DIFFERENT POSITIONS ON A WEARER'S HEAD

(71) Applicant: Mackenzie Rae Arnott, Chemainus (CA)

(72) Inventor: Mackenzie Rae Arnott, Chemainus (CA)

( * ) Notice: Subject to any disclaimer, the term of this patent is extended or adjusted under 35 U.S.C. 154(b) by 85 days.

(21) Appl. No.: 15/168,186

(22) Filed: May 30, 2016

(65) Prior Publication Data

US 2017/0020222 A1 Jan. 26, 2017

Related U.S. Application Data

(60) Provisional application No. 62/192,261, filed on Jul. 14, 2015.

(51) Int. Cl.
*A42B 1/22* (2006.01)

(52) U.S. Cl.
CPC ..... *A42B 1/225* (2013.01)

(58) Field of Classification Search
CPC ..... A41B 1/125; A41B 1/02; A41B 1/225; A41B 1/067
USPC ..... 2/209.3, 171.7, 209.7, 174, 209.13
See application file for complete search history.

(56) References Cited

U.S. PATENT DOCUMENTS 5,511,249 A * 4/1996 Higgins ..... A42B 1/225 2/195.1
5,644,799 A * 7/1997 Armenta ..... A42B 1/225 132/273
5,799,334 A * 9/1998 Griffith ..... A42B 1/225 2/171
5,875,494 A * 3/1999 Garnier, Jr. ..... A42B 1/225 2/171.5
7,047,571 B1 * 5/2006 Kelly ..... A42B 1/225 132/54
8,108,944 B1 * 2/2012 Gilson, Sr. ..... A42B 1/067 2/12
2003/0135912 A1 * 7/2003 White ..... A42B 1/225 2/195.8
2005/0066421 A1 * 3/2005 Brundage ..... A42B 1/225 2/209.3
2005/0108810 A1 * 5/2005 Yan ..... A42B 1/062 2/195.4
2006/0010566 A1 * 1/2006 Ridgeway ..... A42B 1/225 2/171
2006/0137074 A1 * 6/2006 Laing ..... A42B 1/225 2/195.2
2006/0191057 A1 * 8/2006 Lynn ..... A41G 5/0093 2/171
2006/0206984 A1 * 9/2006 Jaye ..... A42B 1/225 2/209.3
2007/0061944 A1 * 3/2007 Briskie ..... A42B 1/225 2/209.3

(Continued)

*Primary Examiner* — Gloria Hale

(74) *Attorney, Agent, or Firm* — Adrian D. Battison; Ade & Company Inc.; Kyle R. Satterthwaite

(57) ABSTRACT

A headwear piece for comfortably wearing with lengthy hair has a hair opening for passing a bundle of a wearer's hair therethrough. The headwear piece features at least one elastic member spanning across the hair opening, each of which divides the hair opening into separate hair locating sections. The hair locating sections are usable for locating the bundle of hair at different positions on the head of the wearer.

8 Claims, 3 Drawing Sheets

(56) References Cited

U.S. PATENT DOCUMENTS

| | | | | |
|---|---|---|---|---|
| 2007/0118970 | A1* | 5/2007 | Gerstel Costello | A42B 1/225 2/195.2 |
| 2007/0250987 | A1* | 11/2007 | Adkins | A42B 1/225 2/209.3 |
| 2008/0201825 | A1* | 8/2008 | Chun | A42B 1/225 2/209.13 |
| 2008/0209615 | A1* | 9/2008 | Raftery | A42B 1/225 2/209.13 |
| 2009/0083898 | A1* | 4/2009 | Shirey | A42B 1/225 2/209.7 |
| 2009/0151047 | A1* | 6/2009 | Garza | A42B 1/225 2/174 |
| 2009/0255030 | A1* | 10/2009 | Guy | A42B 1/225 2/84 |
| 2010/0205715 | A1* | 8/2010 | Dillavou | A42B 1/225 2/69 |
| 2013/0025026 | A1* | 1/2013 | Smith | A42B 1/225 2/209.3 |
| 2013/0074246 | A1* | 3/2013 | Rogers | A42B 1/225 2/209.3 |
| 2014/0082826 | A1* | 3/2014 | Kuthari | A42B 1/02 2/171.7 |
| 2014/0130235 | A1* | 5/2014 | Johnson | A42B 1/225 2/209.3 |
| 2014/0338092 | A1* | 11/2014 | Kinsey | A41D 1/04 2/84 |

* cited by examiner

HEADWEAR ITEM COMPRISING HAIR LOCATING SECTIONS FOR LOCATING A BUNDLE OF HAIR AT DIFFERENT POSITIONS ON A WEARER'S HEAD

This application claims the benefit under 35 USC 119(e) of U.S. Provisional application Ser. No. 62/192,261, filed Jul. 14, 2015.

FIELD OF THE INVENTION

The present invention generally relates to headwear such as caps, and more particularly to headwear items having a hair opening for passing a bundle of hair therethrough.

BACKGROUND

People with long or lengthy hair have difficulty wearing traditional headwear items such as caps. Typically, caps do not have a means to accommodate the hair when it is gathered in a style such as a bun or ponytail so as to keep the hair out of the way of the face. Although caps often lack the structure for accommodating such lengthy hair, it remains desirable to wear a hat and keep long hair out of one's face such as during outdoor activities.

One way in which wearers with long hair have adapted their hair style so that they may wear caps is by putting their hair into a ponytail or bun which is in a position that is vertically low along the back of the head. Although the bundle of hair in such a position allows for the wearer to place the cap on their head in an optimally seated position thereon, the cap may tend to shift against the accumulation of hair and ride up the head so that the wearer frequently feels the need to pull the cap down back into the optimum position.

It is therefore desirable to provide a headwear piece which accommodates lengthy hair in a comfortable manner and which may overcome the aforementioned shortcomings of wearing a cap with long hair gathered in a bundle placed lowly along the back of the head.

SUMMARY OF THE INVENTION

According to one aspect of the invention there is provided a headwear item for comfortably wearing with lengthy hair comprising:

a cap portion formed as a generally hemi-spherical body having an apex at a top of the cap portion and an annular periphery at a bottom of the cap portion that defines a head opening for receiving a head of a wearer within the cap portion;

a hair opening in the cap portion sized smaller than the head opening for passing a bundle of hair of the wearer therethrough;

the hair opening being located between the annular periphery and the apex;

at least one elongate elastic member spanning across the hair opening;

each elastic member dividing the hair opening into separate hair locating sections, each of which is collectively defined by a portion of a periphery of the hair opening and a side of the respective elastic member;

the hair locating sections being usable for locating the bundle of hair at different positions on the head of the wearer.

In the embodiment described in more detail hereinafter, the wearer may locate his or her bundle of hair in a position on his or her head corresponding to one of the hair locating sections that is personally most comfortable to the wearer. For example, some people prefer to wear the bundle of hair higher up on their heads while others may prefer to wear it in a lower position thereon. With the bundle of hair extending through one of the hair locating sections as opposed to, for example, seating the cap on the wearer's head with the bottom of the cap portion resting on the bundle of hair like in traditional caps, the cap portion is resisted from shifting about the head due to butting engagement with the bundle of hair. Thus, people with lengthy hair are able to enjoy the benefits of wearing a cap while comfortably wearing same.

Preferably, said at least one elastic members comprises a plurality of elastic members spanning across the hair opening at spaced positions relative to one another.

One or more of said at least one elastic member has an inner surface facing inwardly towards an inside of the cap portion that may comprise a gripping material usable for resisting movement of the cap portion relative to the head of the wearer.

Typically the gripping material is a polymeric material.

Preferably, each elastic member is sufficiently resilient to resist deformation from its prearranged path across the opening as at fabrication so as to provide support for the bundle of hair resting on the respective elastic member.

In one arrangement the respective elastic member spans generally horizontally across the hair opening such that the hair locating sections are formed one above the next.

In one arrangement there is provided an adjuster opening at or adjacent the annular periphery of the cap portion with a pair of cooperating mating straps arranged to span across the adjuster opening so as to be operable for adjusting a size of the annular periphery to fit different sizes of heads, and the hair opening is located on the cap portion angularly above the adjuster opening such that the hair opening is spaced therefrom in a direction generally towards the apex from the annular periphery.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
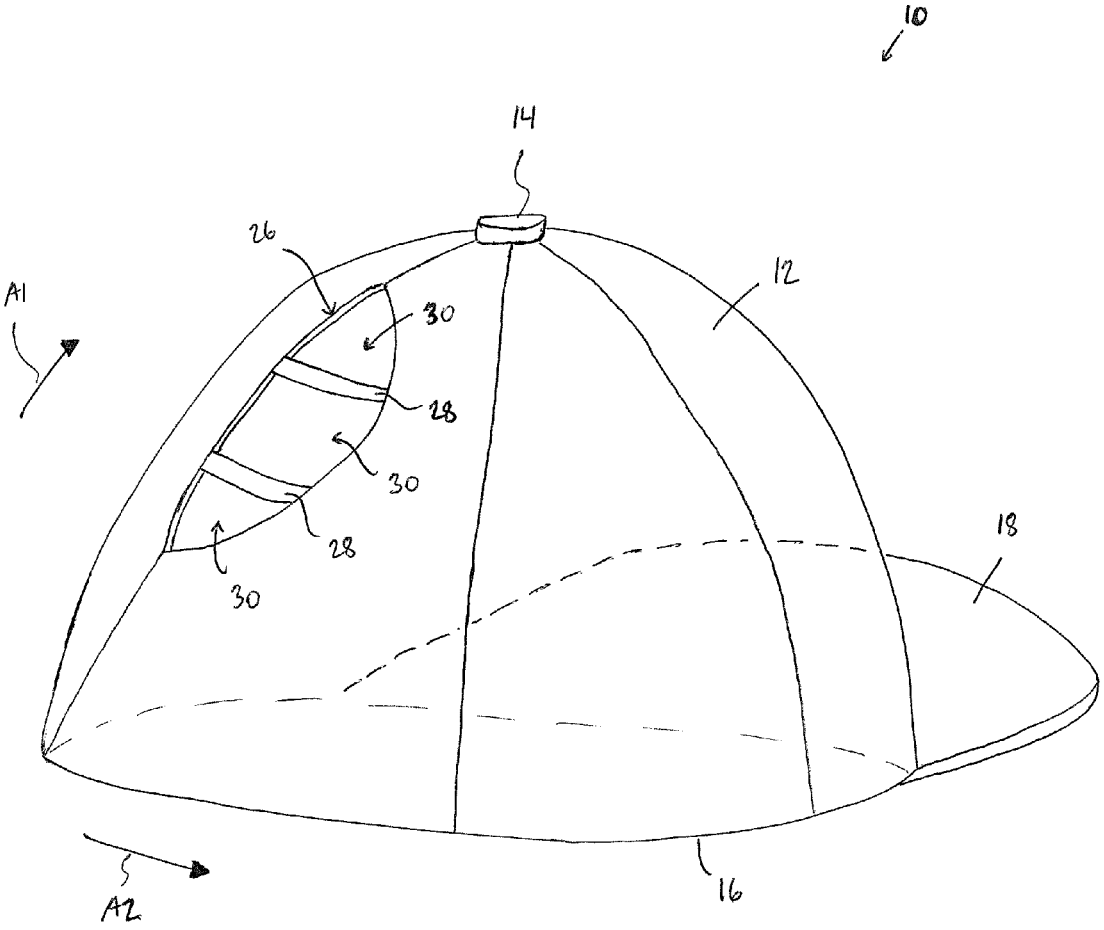
FIG. 1 is a rear perspective view of a cap hat according to the present invention.

Referring to the accompanying figures, there is illustrated a headwear piece generally indicated by reference numeral 10. Typically, the headwear piece or item comprises a cap. The cap may include one of a variety of different versions such as a golf cap, baseball cap, trucker cap, snapback cap, fitted cap, camper 5-panel cap, military cap, and bucket cap but is not limited to these examples. The variety of different versions of caps also includes low, medium, and high profile caps. Generally speaking, the type of cap which is of concern in the present specification is that which has a cap portion 12 that covers a crown of a wearer's head 1. As such, a visor cap is not pertinent to the present specification. The fitted cap is illustrated in the figures of the drawings.

The cap portion 12 generally forms a hemi-spherical body. This body has an apex 14 at a central top of the cap portion and an annular peripheral rim 16 at a bottom of the cap portion that rings about the apex. The rim 16 defines a head opening for receiving the wearer's head 1 within the cap portion 12. Also, the cap typically includes a visor portion 18 extending generally radially outwardly from the rim 16 along a forward portion of the cap portion.

Figure 2:
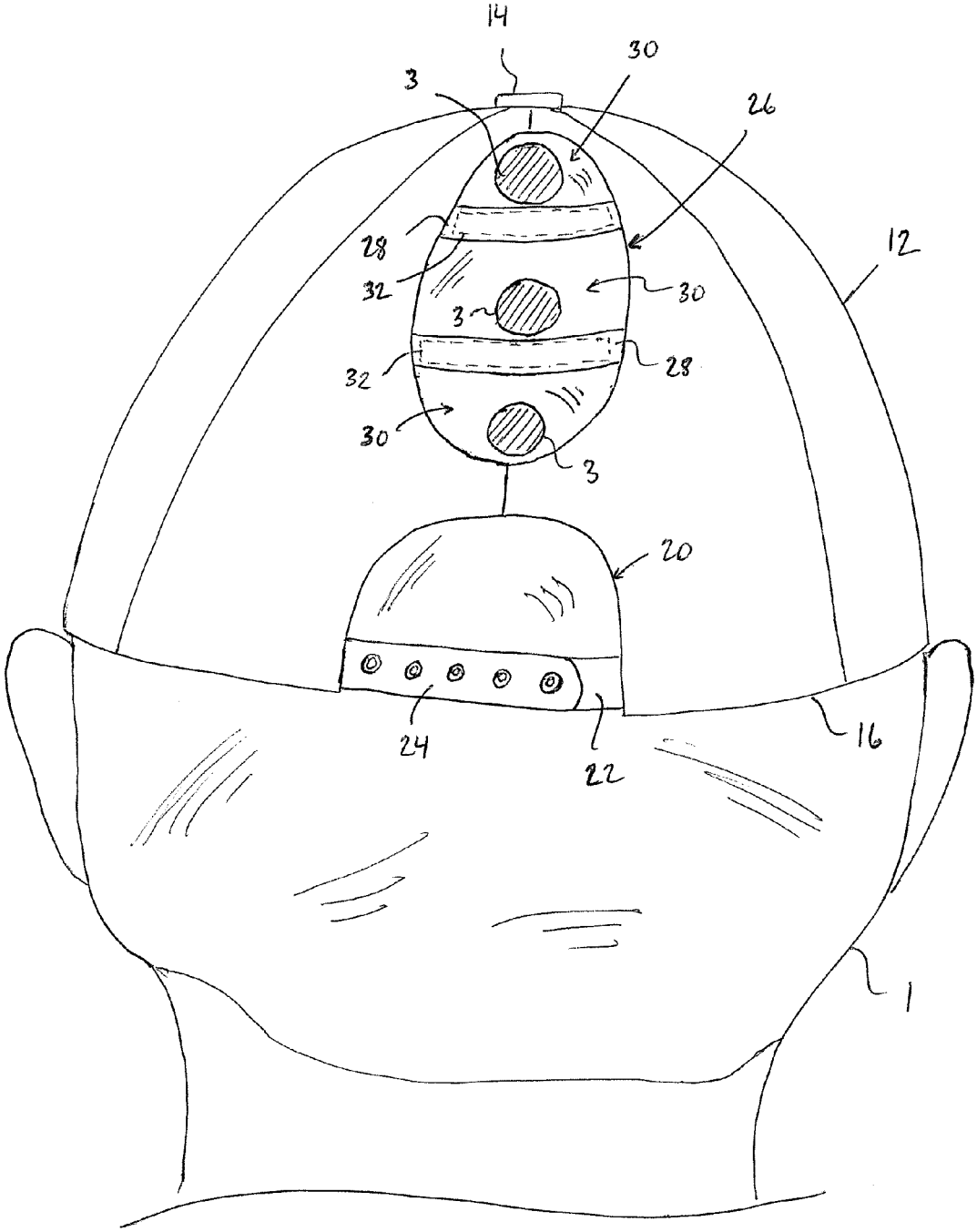
FIG. 2 is a rear elevation view of a cap hat, which is similar to that of FIG. 1 but includes an adjuster opening, schematically showing a bundle of hair located in each hair locating section.
Figure 3:
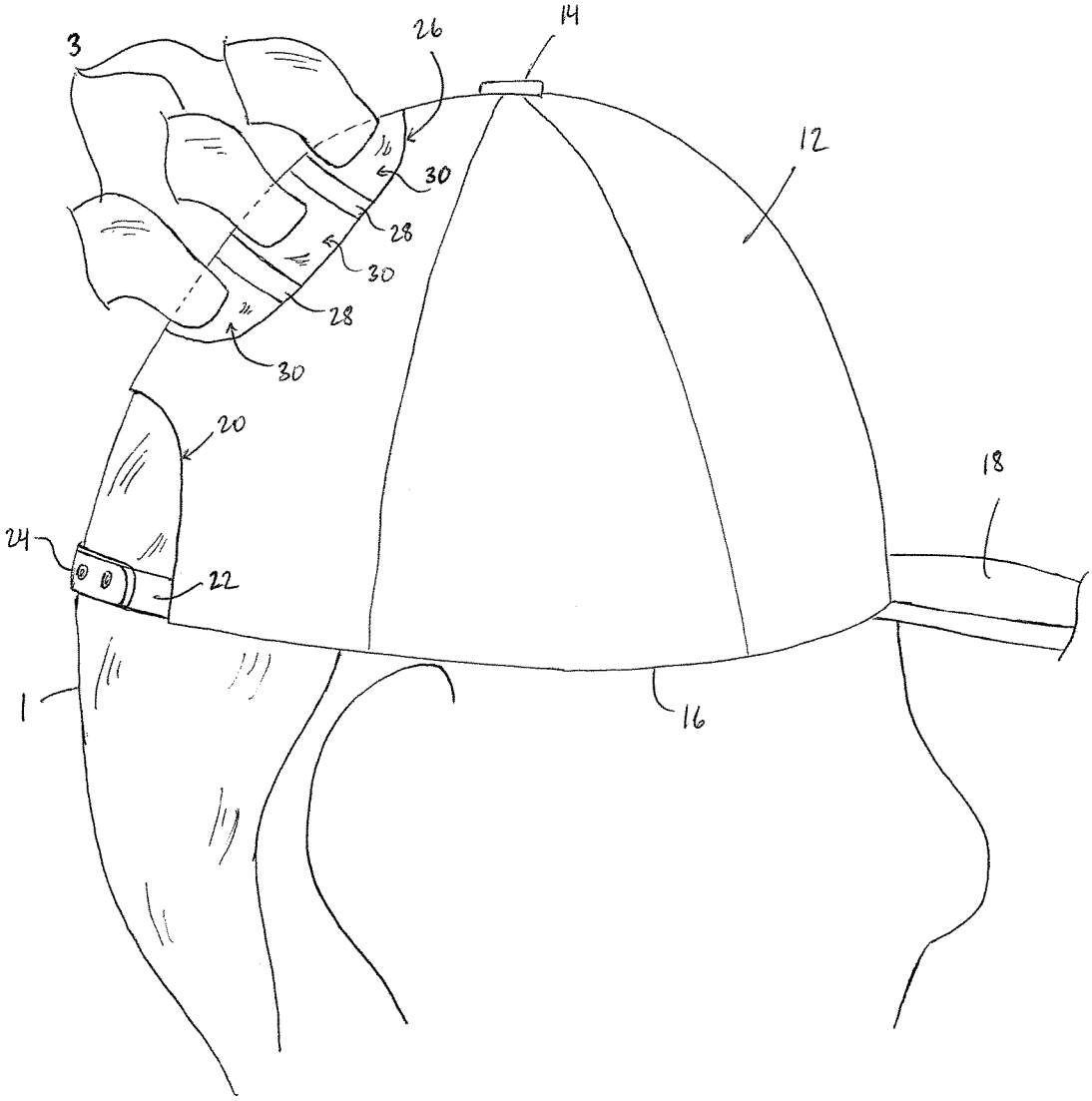
FIG. 3 is a side elevation view of the cap hat as shown in FIG. 2.

As illustrated in FIGS. 2 and 3, the cap may also have an adjuster opening 20 and a base strap 22 and overlapping mating strap 24 lying along the periphery of the cap portion 12 for adjusting a size of the rim to fit different sizes of heads. Such adjuster openings are known in the art and thus not described in further detail herein.

In order to fit comfortably on the head 1 of the wearer or user with lengthy hair, the cap includes a hair opening 26 in the cap portion 12, typically at a back of the cap so as to be opposite the visor portion 18. The hair opening 26 is disposed in the generally hemi-spherical body at a location which is between the apex 14 and the rim 16 in a first angular direction, indicated by the solid headed arrow at A1, across the cap portion traversing from the bottom thereof to the top. For a cap which has the adjuster opening 20 as shown in FIGS. 2 and 3, the hair opening 26 is arranged angularly between the adjuster opening 20 and the apex 14.

The cap 10 may be manufactured with the hair opening 26 or, alternatively, may be modified to include the hair opening 26. Such modifications may include cutting a hole in a rearmost gore of the cap portion or removing stitching which joins two rearmost gores along the first angular direction A1 and folding the fabric of each gore inward so as to form a hole, which may be followed by stitching the folded portions of the fabric in place.

At least one elongate elastic member 28 spans across the hair opening 26 so as to divide the larger hair opening into smaller, individual hair locating sections 30. In the illustrated embodiment, two elastic members 28 in the form of strips are spaced from one another in the first angular direction A1 of the cap portion and each extends from a location on one side of the hair opening 26 towards an opposite location on the periphery of the hair opening in a second angular direction, indicated by the solid headed arrow at A2, along the cap portion parallel to the rim 16. As such, the elastic strips 28 are oriented in a manner parallel to the rim 16. Thus, three hair locating sections are formed. Note that in other embodiments, a different number of elastic members may be used to portion the hair opening into a different number of sections. Furthermore, the strips may be oriented so as to extend in the first angular direction in addition to or alternatively to the second angular direction A2.

Each hair locating section 30 is separate from one another and is defined or delimited by a bordering portion of a periphery of the hair opening 26 and side of the respective strip which adjoins the hair opening's bordering periphery of that hair locating section. Also, each end of each elastic strip 28 is located at a spaced position from an adjacent end of another one of the strips. Thus, each hair locating section is disposed at a different location relative to the wearer's head and provides a sufficiently sized opening for passing through the section 30 a bundle of hair 3 extending from the wearer's head at that section's respective location.

The elastic strips 28 may comprise one of a stretchy fabric, a rubber material, and a combination thereof. In the illustrated embodiment, the strips 28 are joined to the cap portion 12 along an exposed peripheral edge of the hair opening 26 such that a seam or stitch between the respective strip and the cap portion is along the peripheral edge of the hair opening. This coupling may be achieved by conventional fastening techniques or arrangements for headwear or more generally for clothing, such as stitching.

Each strip 28 is sufficiently resilient so as to not apply discomforting pressure to the bundle of hair 3 passing through the hair opening 26 if the strip comes into butting engagement therewith as if, for example, the bundle of hair is not centrally aligned with the respective hair locating section.

Each strip 28 is also sufficiently resilient so as to resist substantial deformation from its predetermined or prearranged path as at fabrication (i.e., at the time when the strip was made with or coupled to the cap)—that is, the path which the strip follows between the strip's ends which are in fixed position at the periphery of the hair opening 26. Thus, the respective strip 28 may provide support for the bundle of hair 3 resting thereon.

In the illustrated embodiment as schematically shown in FIG. 2, each elastic strip 28 comprises a gripping material 32 on an inner surface of the strip that faces inwardly towards an inside of the cap portion. The gripping material frictionally engages the wearer's hair and head when the cap is received snugly over the wearer's head thereby resisting movement of the hat relative to the head, especially shifting in the first angular direction or opposite thereto due to butting engagement of part of the cap 10 with the bundle of hair 3. The gripping material 32 may comprise a body of polymeric material like silicone so as to be in the form of a coating on the elastic strip 28 at the inner surface thereof. Alternatively, the gripping material 32 may comprise polymeric material like the silicone in a manner which is integral with the elastic strip 28 such that the gripping material and strip form a single body.

In use, the wearer typically forms his or her hair into a bundle which is sized to fit through one of the hair locating sections 30. The wearer forms the bundle of hair at a location on his or her head which is generally alignable with one of the hair locating sections but also which the wearer deems comfortable. The wearer may then pass the bundle of hair through the section 30 which most appropriately fits the position of the bundle on their head and put the cap portion onto the wearer's head. To remove the cap from the wearer's head, the reverse process is followed.

Alternatively, the wearer may put on the cap 10 on his or her head. Once the cap is received on the wearer's head, the wearer can pass his or her hair through one of the hair locating sections 30 and form the bundle 3 at the respective hair location sections.

Note that the wearer may wear a hair elastic for retaining his or her hair in the bundle as formed while wearing the cap.

In alternative embodiments, each attached end of the respective elastic member pulls opposing side portions of the respective hair locating section inwardly toward one another. This pulling action is not exceedingly strong so that the hair opening generally retains its original shape. As such, by this pulling action the respective hair locating section provides support along at least a portion of a periphery thereof for the bundle of hair extending therethrough. This support is formed by resiliency of the elastic member and strength of the cap portion's fabric.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A headwear item for comfortably wearing on a wearer's head having lengthy hair comprising:

a cap portion formed as a generally hemi-spherical body having an apex at a top of the cap portion and an annular periphery at a bottom of the cap portion that defines a head opening for receiving the head of the wearer within the cap portion;

a hair opening in the cap portion sized smaller than the head opening for passing a bundle of hair of the wearer therethrough;

the hair opening being located between the annular periphery and the apex;

at least one elongate member spanning across the hair opening;

each elongate member dividing the hair opening into separate hair locating sections, each of which is collectively defined by a portion of a periphery of the hair opening and a side of the respective elongate member;

the hair locating sections being usable for locating the bundle of hair at different positions on the head of the wearer.

2. The headwear item according to claim 1 wherein said at least one elongate member comprises a plurality of elongate members spanning across the hair opening at spaced positions relative to one another.

3. The headwear item according to claim 1 wherein one or more of said at least one elongate member has an inner surface facing inwardly towards an inside of the cap portion that comprises a gripping material usable for resisting movement of the cap portion relative to the head of the wearer.

4. The headwear item according to claim 3 wherein the gripping material is a polymeric material.

5. The headwear item according to claim 1 wherein the respective elongate member spans generally horizontally across the hair opening such that the hair locating sections are formed one above the next.

6. The headwear item according to claim 1 wherein there is provided an adjuster opening at or adjacent the annular periphery of the cap portion with a pair of cooperating mating straps arranged to span across the adjuster opening so as to be operable for adjusting a size of the annular periphery to fit different sizes of heads, and the hair opening is located on the cap portion angularly above the adjuster opening such that the hair opening is spaced therefrom in a direction generally towards the apex from the annular periphery.

7. The headwear item according to claim 1 wherein said at least one elongate member is elastic.

8. The headwear item according to claim 7 wherein each elongate member is sufficiently resilient to resist deformation from its prearranged path across the opening as at fabrication so as to provide support for the bundle of hair resting on the respective elongate member.

* * * * *